US009963952B2

(12) United States Patent
Hallundbæk et al.

(10) Patent No.: US 9,963,952 B2
(45) Date of Patent: May 8, 2018

(54) ANNULAR BARRIER WITH A SEAL

(71) Applicant: WELLTEC A/S, Allerød (DK)

(72) Inventors: Jørgen Hallundbæk, Græsted (DK); Lars Stæhr, Glostrup (DK)

(73) Assignee: WELLTEC A/S, Allerød (DK)

( * ) Notice: Subject to any disclaimer, the term of this patent is extended or adjusted under 35 U.S.C. 154(b) by 614 days.

(21) Appl. No.: 14/385,539

(22) PCT Filed: Mar. 27, 2013

(86) PCT No.: PCT/EP2013/056468

§ 371 (c)(1),
(2) Date: Sep. 16, 2014

(87) PCT Pub. No.: WO2013/144181

PCT Pub. Date: Oct. 3, 2013

(65) Prior Publication Data

US 2015/0068774 A1 Mar. 12, 2015

(30) Foreign Application Priority Data

Mar. 30, 2012 (EP) ..... 12162458

(51) Int. Cl.
*E21B 33/127* (2006.01)

(52) U.S. Cl.
CPC ..... *E21B 33/127* (2013.01); *E21B 33/1277* (2013.01)

(58) Field of Classification Search
CPC ..... E21B 33/1208; E21B 33/1277
See application file for complete search history.

(56) References Cited

U.S. PATENT DOCUMENTS 2,451,762 A 10/1948 Millikan
3,520,361 A 7/1970 Lewis
4,515,213 A 5/1985 Rogen et al.
4,892,144 A * 1/1990 Coone ..... E21B 33/1295 166/122
4,979,570 A 12/1990 Mody
(Continued)

FOREIGN PATENT DOCUMENTS

CN 101194083 A 6/2008
CN 101514618 A 8/2009
(Continued)

OTHER PUBLICATIONS

Notification of the First Office Action dated Jun. 3, 2016 in Chinese Application No. 201380014228.X, with English translation (10 pages).

(Continued)

*Primary Examiner* — Robert E Fuller
(74) *Attorney, Agent, or Firm* — Nixon & Vanderhye, P.C.

(57) ABSTRACT

A downhole annular barrier with an axial extension having an outer surface facing an inner surface of an outer structure has a tubular part, an expandable part, and at least one annular sealing element. The annular sealing element is connected with the expandable part and has an axial length along the axial extension of the downhole annular barrier which is less than 50% of a length of the downhole annular barrier along the axial extension of the downhole annular barrier. The annular sealing element has a spring element.

18 Claims, 10 Drawing Sheets

(56) References Cited

U.S. PATENT DOCUMENTS

| | | | |
|---|---|---|---|
| 5,327,963 | A | 7/1994 | Vance, Sr. et al. |
| 7,216,706 | B2 | 5/2007 | Echols et al. |
| 7,891,431 | B2 | 2/2011 | Freyer |
| 8,894,069 | B2 | 11/2014 | Xu et al. |
| 2005/0217850 | A1 | 10/2005 | Cho et al. |
| 2012/0299246 | A1 | 11/2012 | Farrar et al. |

FOREIGN PATENT DOCUMENTS

| | | | |
|---|---|---|---|
| CN | 201474655 | U | 5/2010 |
| RU | 2 177 532 | C2 | 12/2001 |
| RU | 2 224 872 | C1 | 2/2004 |
| RU | 2 441 973 | C2 | 2/2012 |
| SU | 1684481 | A1 | 10/1991 |

OTHER PUBLICATIONS

International Search Report for PCT/EP2013/056468, dated Aug. 26, 2013.
Written Opinion of the ISA for PCT/EP2013/056468, dated Aug. 26, 2013.
Written Opinion of the IPEA for PCT/EP2013/056468, dated Mar. 12, 2014.
Extended European Search Report dated Aug. 31, 2012 in European Application No. 12162458.9 (6 pages).
Office Action of Substantive Examination dated Feb. 13, 2017 in Russian Application No. 2014140984/03(066441), with English Translation (16 pages).

* cited by examiner

ANNULAR BARRIER WITH A SEAL

This application is the U.S. national phase of International Application No. PCT/EP2013/056468 filed 27 Mar. 2013 which designated the U.S. and claims priority to EP Patent Application No. 12162458.9 filed 30 Mar. 2012, the entire contents of each of which are hereby incorporated by reference.

FIELD OF THE INVENTION

The present invention relates to a downhole annular barrier with an axial extension having an outer surface facing an inner surface of an outer structure, comprising a tubular part, an expandable part, and at least one annular sealing element. Also, the present invention relates to a downhole system and to a seal providing method.

BACKGROUND ART

In wellbores, downhole annular barriers are used for different purposes, such as for providing a barrier for flow between an inner and an outer tubular structure or between an inner tubular structure and the inner wall of the borehole. The downhole annular barriers are mounted as part of the well tubular structure. A downhole annular barrier has an inner wall surrounded by an annular expandable sleeve. The expandable sleeve is typically made of an elastomeric material, but may also be made of metal. The sleeve is fastened at its ends to the inner wall of the downhole annular barrier.

In order to seal off a zone between an inner and an outer tubular structure or a well tubular structure and the borehole, a second annular barrier is used. The first annular barrier is expanded on one side of the zone to be sealed off, and the second annular barrier is expanded on the other side of that zone, and in this way, the zone is sealed off.

The quality of the seal of a sealed off zone is often defined by the flow of borehole fluids passing a seal, e.g. the requirements of a certain seal may be a maximum limit of a few litres per minute passing the seal to meet the requirements set up by the user. Therefore, a certain level of fluid leaking into or away from the sealed of zone is typically allowed and acceptable, but the quality of the seal is compromised if too much fluid can pass the seal.

When annular barriers are expanded, they typically tend to spring back when the expansion has ended. The spring back effect occurs when the pressure on the expandable part used to expand the expandable part is terminated. Termination of the expansion pressure will result in a small decrease in size of the expandable part due to elastic retraction of the expanded material. Also, other settling effects, such as pressure equalisation in the annular barrier, may cause a minor minimisation of the size of the barrier. Even when using metals, such as steel, a spring back effect of a few percent may be expected. The spring back effect of the expandable part negatively affects the quality of the seal provided by the downhole annular barrier 1, since the seal becomes poorer after expansion in terms of tightness or the amount of fluid possibly passing the seal.

It is thus desirable to provide a solution whereby the problems caused by spring back effects and other settling effects of the annular barrier material after expansion can be avoided.

SUMMARY OF THE INVENTION

It is an object of the present invention to wholly or partly overcome the above disadvantages and drawbacks of the prior art. More specifically, it is an object to provide an improved downhole annular barrier which, despite the problems with spring back effects and other settling effects in all materials usable for annular barriers, may provide improved sealing, thereby increasing the quality of the seal provided by the downhole annular barrier.

The above objects, together with numerous other objects, advantages, and features, which will become evident from the below description, are accomplished by a solution in accordance with the present invention by a downhole annular barrier with an axial extension having an outer surface facing an inner surface of an outer structure, comprising:

- a tubular part,
- an expandable part arranged around the tubular part, and
- at least one annular sealing element connected with the expandable part and having an axial length along the axial extension of the downhole annular barrier being less than 50% of a length of the downhole annular barrier along the axial extension of the downhole annular barrier, wherein the annular sealing element comprises a spring element.

The axial length of the annular sealing element along the axial extension of the downhole annular barrier may preferably be less than 40% of the length of the downhole annular barrier along the axial extension of the downhole annular barrier, more preferably less than 25% of the length of the downhole annular barrier, even more preferably less than 10% of the length of the downhole annular barrier.

In an embodiment, the annular sealing element may further comprise an annular sealing sleeve connected with the expandable part and defining an annular sealing element cavity between the expandable part and the annular sealing sleeve, and the spring element may be arranged in the annular sealing element cavity.

Furthermore, the spring element may be a corrugated annular sealing sleeve.

The invention furthermore relates to a downhole annular barrier, wherein the annular sealing element comprises an annular sealing sleeve connected with the expandable part and defining an annular sealing element cavity between the expandable part and the annular sealing sleeve, and wherein an expandable element is arranged in the annular sealing element cavity.

Moreover, the spring element may be a spring device or a spring, such as a coiled or helical spring.

Also, the annular sealing sleeve may be made of a metallic material.

Further, an expandable element may be arranged in the annular sealing element cavity.

Said expandable part may be an expandable sleeve surrounding the tubular part.

In an embodiment, the expandable sleeve may be a metal sleeve.

Furthermore, the spring element may be made of a metallic material.

In addition, the downhole annular sealing sleeve may have at least one opening or be perforated.

By perforated is meant that the sleeve has a plurality of openings.

Furthermore, the expandable element may be made of a swellable material.

In addition, the annular sealing sleeve may be made of a metallic material.

Moreover, the annular sealing sleeve may be made of an elastomeric material.

In an embodiment, the expandable part may be an expandable sleeve surrounding the tubular part, the tubular part comprising an aperture for injecting pressurised fluid into the space defined by the expandable sleeve and the tubular part.

Additionally, the annular sealing sleeve may be made of a material having a lower E-modulus than the expandable part.

The downhole annular barrier described above may further comprise connection parts for connecting the annular sealing sleeve with the expandable part.

Moreover, the expandable part may further comprise a valve.

Also, the downhole annular barrier may further comprise a sensor for determining a pressure exerted by the annular sealing element on the inner surface of the outer structure.

The downhole annular barrier may further comprise a sensor for determining a temperature of the fluid in the annular sealing element cavity.

Furthermore, the downhole annular barrier may comprise a sensor for determining a length of the perimeter of the downhole annular barrier.

In addition, the downhole annular barrier may comprise a first connection part surrounding and connected with a first end of the tubular part and a second connection part surrounding and connected with a second end of the tubular part.

Additionally, the downhole annular barrier may comprise a first connection part surrounding and connected with the tubular part and a second connection part surrounding and connected with the tubular part.

In an embodiment, the expandable part may be connected with the first connection part and the second connection part, the expandable part, the first and second connection parts and the tubular part enclosing an inner space, and the first connection part may be slidably connected with the tubular part.

Furthermore, the spring may be a coiled spring.

The coiled spring may be wound with a plurality of windings around the expandable part.

In addition, the at least one coiled spring may form a closed loop around the expandable part and have two ends joined so as to form a ring.

Furthermore, the downhole annular barrier may comprise an expandable part having a centre axis extending outside the tubular part in the longitudinal direction.

Moreover, the centre axis of the expandable part may coil around the tubular part in the longitudinal direction.

Additionally, a cross-section of the expandable tube may be substantially oval-shaped in a relaxed position.

Further, a cross-section of the expandable tube may be substantially circular in an expanded position.

In an embodiment, the downhole annular barrier may comprise a plurality of expandable parts extending on the outside of the tubular part in the longitudinal direction.

Furthermore, the downhole annular barrier may comprise a plurality of spring elements within one annular sealing element cavity.

Moreover, both an expandable element, such as a swellable material, and a spring element may be arranged in the annular sealing element cavity.

The present invention further relates to a downhole system comprising a well tubular structure and at least one downhole annular barrier as described above, wherein the tubular part forms part of the well tubular structure.

Furthermore, a plurality of downhole annular barriers may be positioned at a distance from each other along the tubular part.

The invention furthermore relates to a seal providing method comprising the steps of:

- inserting a downhole annular barrier as described above in a borehole,
- expanding the expandable part by injecting pressurised fluid into an aperture,
- compressing the spring element when the outer surface of the downhole annular barrier engages the inner surface of the outer structure by further injecting pressurised fluid into the aperture,
- minimising the expandable part when the injection of pressurised fluid has ended due to spring back of the expandable part, and
- decompressing the spring element so that the pressure exerted by the annular sealing element on the inner surface of the outer structure is maintained, and a sealing effect of the downhole annular barrier is maintained.

Moreover, the invention relates to a seal providing method comprising the steps of:

- inserting a downhole annular barrier as described above in a borehole,
- expanding the expandable part by injecting pressurised fluid into an aperture,
- minimising the expandable part by ending the injection of pressurised fluid due to spring back of the expandable part, and
- expanding the expandable element so that the pressure exerted by the annular sealing element on the inner surface of the outer structure is maintained, and a sealing effect of the downhole annular barrier is maintained.

In an embodiment, the expandable part may be made of a swellable material which swells by allowing a fluid to enter the annular sealing element cavity.

In another embodiment, the expandable part may be made of a swellable material, and the swelling may be controlled by deliberately injecting a fluid into the annular sealing element cavity using injection means.

Finally, the invention relates to a seal providing method comprising the steps of:

- inserting a downhole annular barrier as described above in a borehole,
- expanding the expandable part by injecting pressurised fluid into an aperture, and
- injecting a fluid into the annular sealing element cavity.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 2:
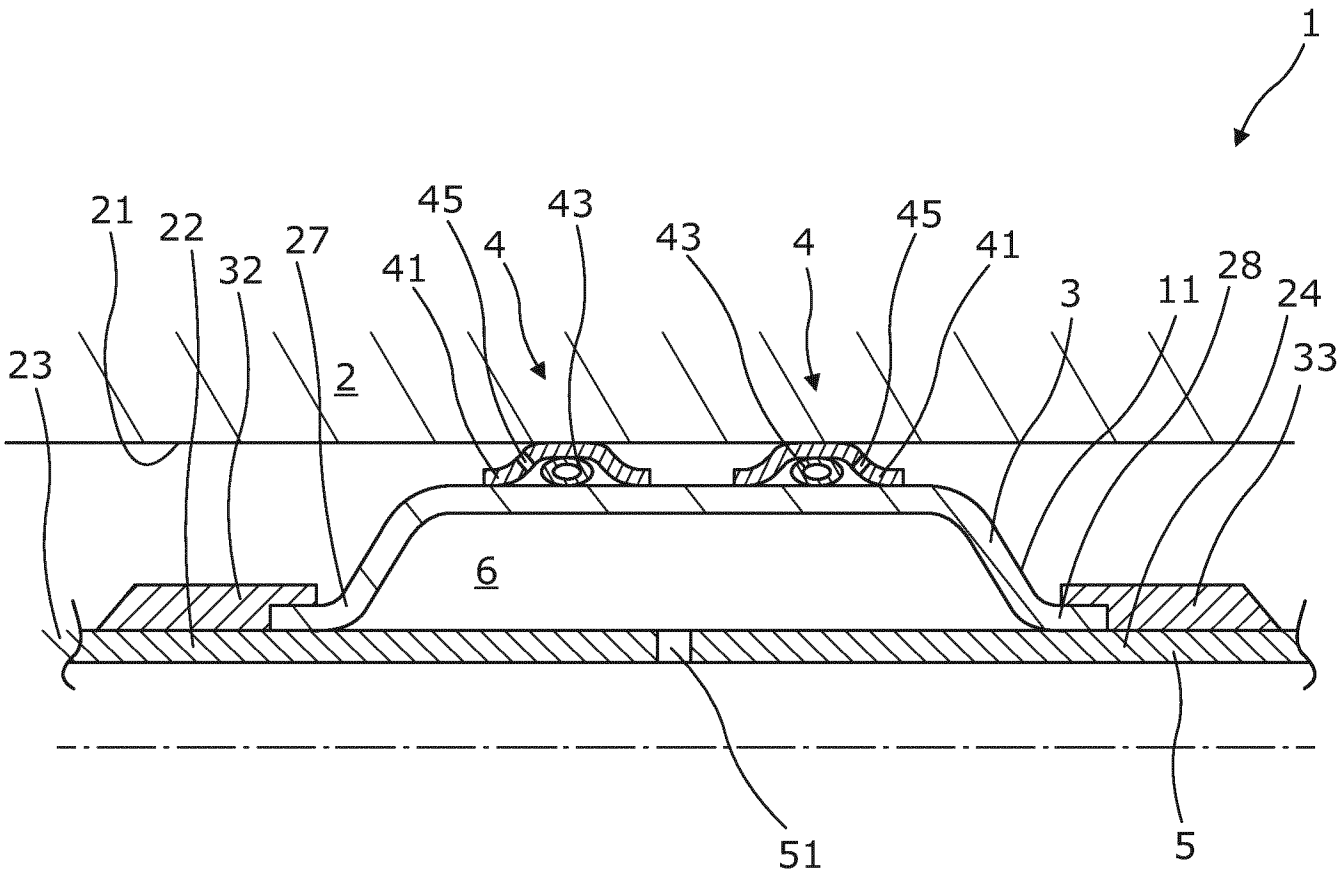
FIG. 2 shows a schematic view of a downhole annular barrier.

Downhole annular barriers 1 according to the present invention are typically mounted as part of the well tubular structure string before the well tubular structure 23 is lowered into the borehole downhole, as shown in the cross-sectional view of one downhole annular barrier in FIG. 2. The well tubular structure 23 is constructed by well tubular structure parts put together as a long well tubular structure string. Often, the annular barriers are mounted in between the well tubular structure parts when the well tubular structure string is mounted.

The downhole annular barrier 1 is used for a variety of purposes, all of which require that an expandable part 3 of the downhole annular barrier 1 is expanded, so that an outer surface 11 of the downhole annular barrier 1 abuts an inner surface 21 of an outer structure 2, such as a borehole casing or a formation surrounding a borehole. The downhole annular barrier 1 has an axial extension parallel to the direction of the borehole extension.

Figure 1A:
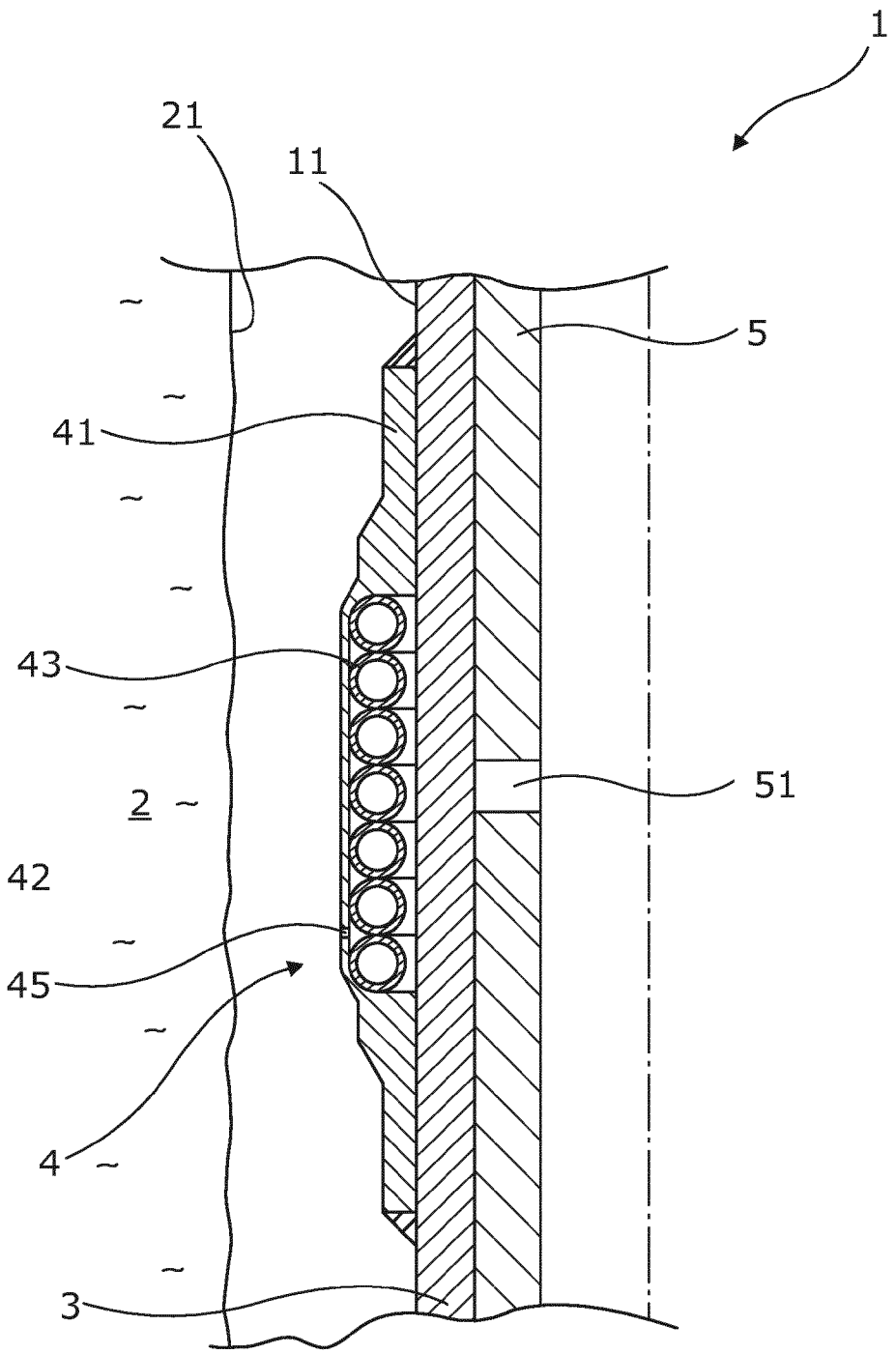
FIG. 1*a* shows a schematic view of a portion of a downhole annular barrier having an annular sealing element.
Figure 1B:
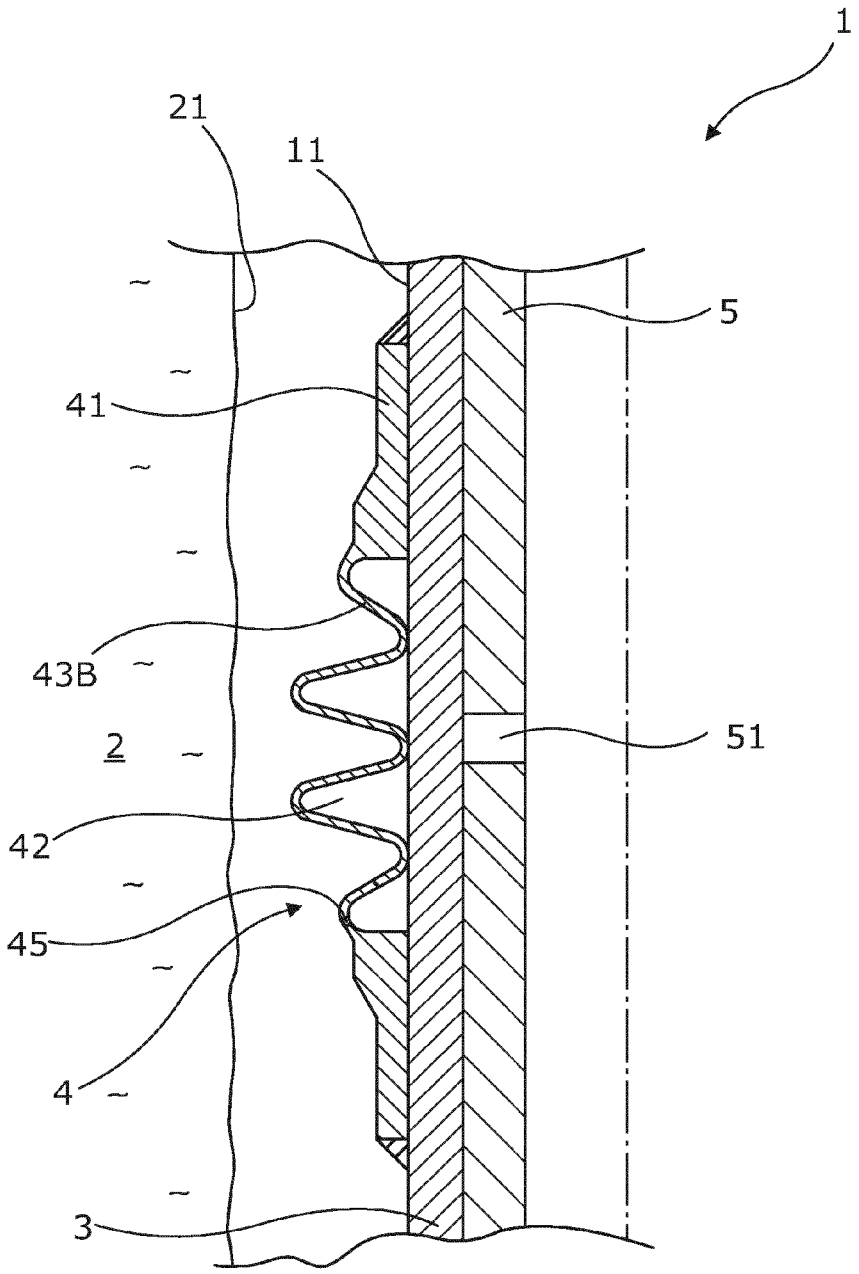
FIG. 1*b* shows a schematic view of a portion of a downhole annular barrier having another embodiment of an annular sealing element.

As shown in FIGS. 1*a* and 1*b*, the downhole annular barrier 1 comprises a tubular part 5 to be mounted as part of the well tubular structure and an expandable part 3 surrounding the tubular part. The expandable part 3 may be an expandable sleeve, as shown in FIG. 2, which may be expanded by injecting a fluid through an aperture 51 of the tubular part 5, thereby increasing a space 6 between the expandable part 3 and the tubular part 5. Outside the expandable part, at least one annular sealing element 4 is arranged in connection with the expandable part 3. The annular sealing element 4 has an axial length along the axial extension of the downhole annular barrier 1 which is less than 50% of a length of the annular barrier along the axial extension of the annular barrier. In this way, the surface area coming into contact with the inner surface 21 of the outer structure 2 is smaller than the surface of the expandable part 3 facing the inner surface 21 of the outer structure. Consequently, the pressure between the inner surface 21 of the outer structure and the outer surface 11 of the annular barrier is increased to improve the sealing effect.

In FIG. 1*a*, the annular sealing element 4 comprises an annular sealing sleeve 41 connected with the expandable part 3, thereby defining an annular sealing element cavity 42 between the expandable part 3 and the annular sealing sleeve 41. A spring element 43 is arranged in the annular sealing element cavity 42 so that when the downhole annular barrier 1 is expanded and engages the inner surface 21 of the outer structure 2, the spring element 43 is compressed. When the expandable part 3 is fully expanded and braces and abuts the inner surface 21 of the outer structure 2 creating a seal, the expansion is terminated, e.g. by de-pressurising or releasing the fluid used for injection through the aperture 51 into the space and letting the fluid flow through the aperture 51 into the tubular part. Then, the material of the expandable part 3 springs back, decreasing a pressure exerted on the inner surface 21 and thereby decreasing the tightness of the seal. The spring back effect and other settling effects occur when the pressure on the expandable part used to expand the expandable part is terminated. Termination of the expanding pressure will result in a small decrease in size of the expandable part due to elastic retraction of the expanded material, and other settling effects such as pressure equalisation in the annular barrier may also cause a minimisation of the size of the barrier. However, since the spring element 43 was compressed during expansion, providing an inherent spring force in the spring element, the spring element 43 expands when the expanded expandable part 3 settles after expansion, thereby maintaining the pressure exerted on the inner surface 21 of the outer structure 2 obtained during expansion of the downhole annular barrier 1. The sealing ability of the downhole annular barrier 1 is substantially increased as the very small gap between the outer structure 2 and the expandable part 3 is reduced compared to prior art solutions which do not have a spring element. As can be seen, the annular sealing sleeve 41 has an opening 45 for letting well fluid into the cavity to press against the sleeve from within if the pressure surrounding the annular barrier increases.

In FIG. 1*b*, the downhole annular barrier 1 comprises an annular sealing element 4 having a spring element where the spring element is a corrugated annular sealing sleeve 43B. Thus, the corrugated annular sealing sleeve 43 forms part of the annular sealing sleeve 41 having the opening 45. When the expandable sleeve of the downhole annular barrier 1 is expanded, the corrugated annular sealing sleeve 43B is compressed, providing an inherent spring force in the corrugated annular sealing sleeve 43B. When the expansion process has ended, the expandable sleeve tends to spring back, resulting in a reduced pressure between the outer structure 2 and the downhole annular barrier 1 or even a small gap between the annular sealing element 4 and the outer structure 2. Simultaneously, the compressed corrugated annular sealing sleeve 43B expands, thereby maintaining the pressure exerted on the inner surface 21 of the outer structure 2 obtained during expansion of the downhole annular barrier 1. The sealing ability of the downhole annular barrier 1 is substantially increased as the pressure between the outer structure 2 and the downhole annular barrier 1 increases or the small gap between the outer structure 2 and the expandable part 3 is reduced or removed. As the corrugated annular sealing sleeve 43B compresses fluid inside, the sleeve 43B is pressed out of the cavity 42, and as the sleeve 43B expands, the fluid enters the cavity 42.

FIG. 2 shows a schematic view of a downhole annular barrier 1 in an expanded state, comprising two annular sealing elements 4 having the annular sealing sleeve 41 arranged outside the expandable part 3 enclosing the spring member 43. The expandable part 3 has been connected with the tubular part 5 by a first connection part 32 and a second connection part 33. The first connection part 32 connects a first end 27 of the expandable sleeve with a first end 22 of the tubular part, and the second connection part 33 connects a second end 28 of the expandable sleeve with the second end 24 of the tubular part. One or more of the connection parts 32, 33 may be fixedly connected with the tubular part or slidably connected with the tubular part 5 to decrease the pressure necessary for expanding the expandable part 3. As illustrated, the spring member 43 is, in a compressed state, indicated by the oval-shaped cross-section of the spring element 43. Since the spring element 43 is compressed, it will decompress towards its original circular shape if the diameter of the expandable part 3 is decreased, e.g. during spring back of the expandable part 3. Also, an increased borehole pressure may decrease the diameter of the expandable part 3 by applying an external force on the expandable part. This type of diameter decrease of the expandable part 3 may also be absorbed by the decompression of the spring element 43.

Figure 3A:
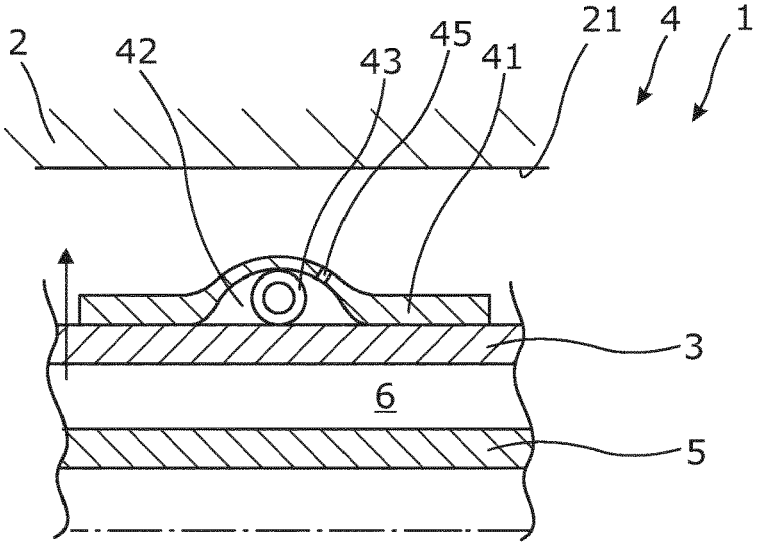
FIGS. 3*a*-3*c* show schematic views of another downhole annular barrier.
Figure 3B:
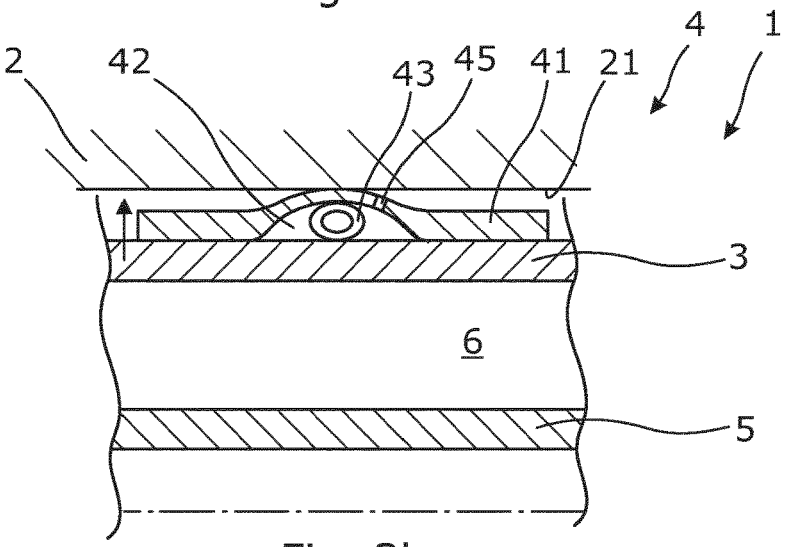
Figure 3C:
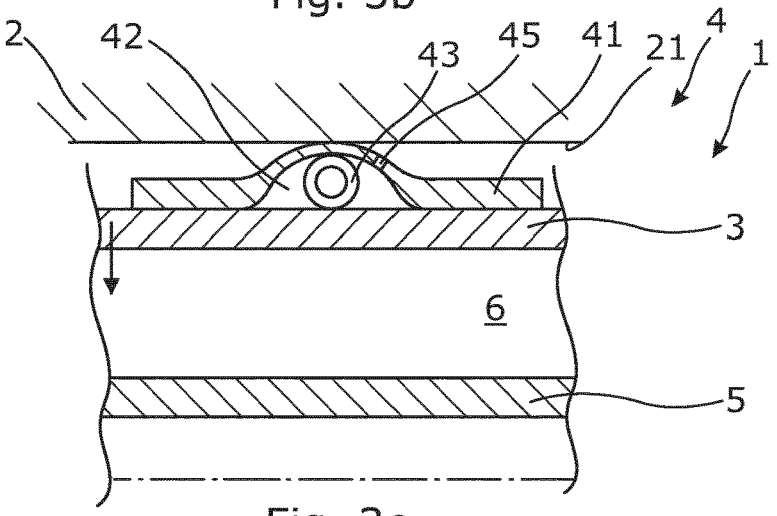

FIGS. 3*a*-3*c* show three consecutive situations during expansion of a downhole annular barrier 1 according to the invention. FIG. 3*a* shows the downhole annular barrier 1 just after expansion has been commenced where fluid has entered the space 6 and the spring element 43 is in an uncompressed state. As shown in FIG. 3*b*, the spring element 43 starts to compress when the annular sealing sleeve engages the inner surface 21 of the outer structure 2 during expansion. As shown in FIG. 3*c*, the expandable part 3 partially retracts when expansion has ended, thereby increasing a distance between the inner surface 21 of the outer structure 2 and the expandable part. Since the spring element 43 was in a compressed state, the spring element 43 will revert to or towards its original uncompressed state with a circular cross-section, as shown in FIG. 3*a*.

Figure 4A:
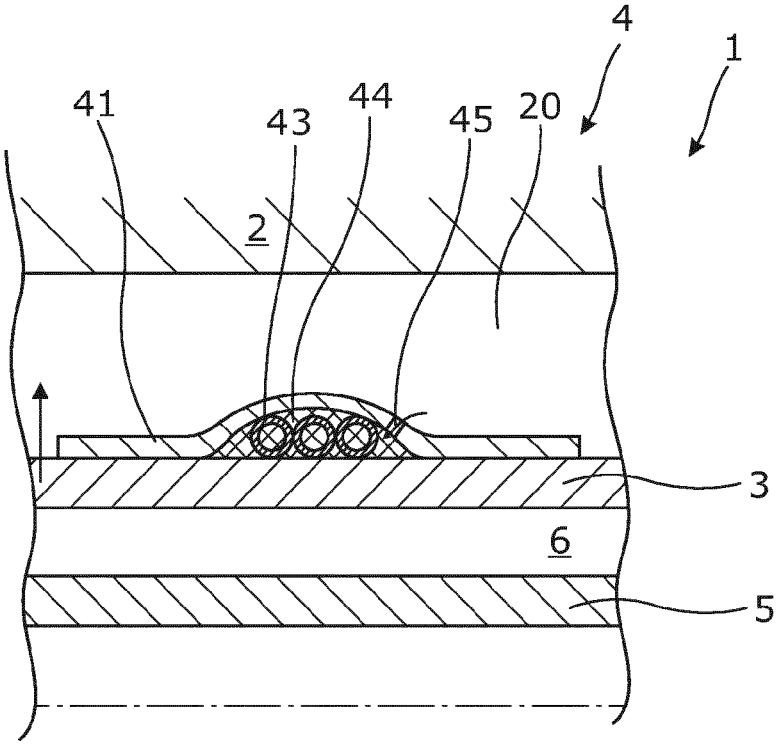
FIGS. 4*a*-4*d* show schematic views of another downhole annular barrier.
Figure 4B:
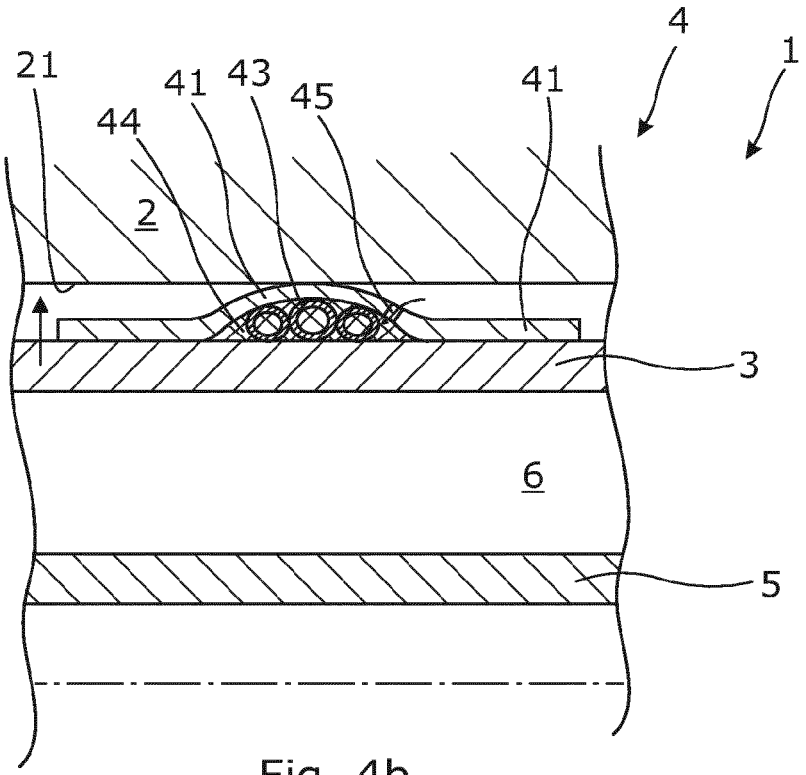
Figure 4C:
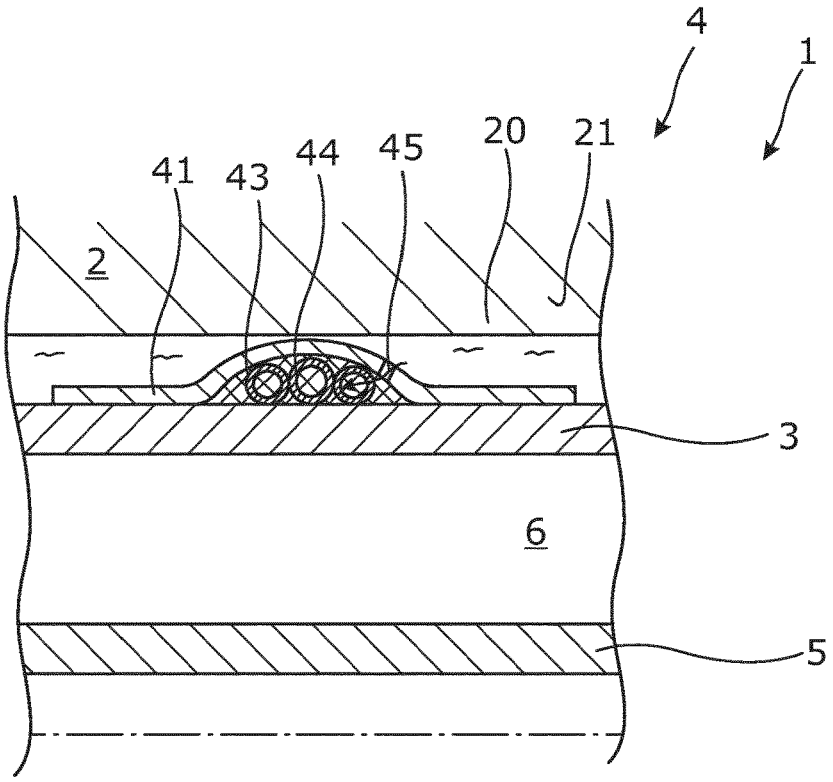
Figure 4D:
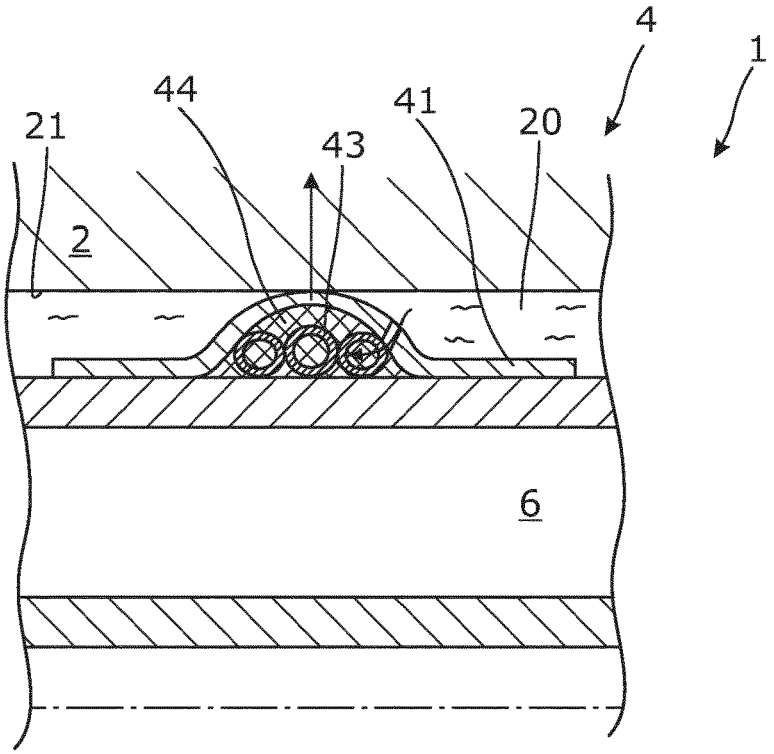

FIGS. 4*a*-4*d* show four consecutive situations during expansion of another downhole annular barrier 1 in which the downhole annular barrier comprises several spring elements 43. FIG. 4*a* shows the downhole annular barrier 1 just after expansion has been commenced. The spring element 43 shown in FIGS. 1-3 is rounded by an expandable element 44, such as an element made of a swellable material. This is a solution to the same problem, i.e. to overcome spring back effect problems in an annular barrier by providing an annular sealing element capable of increasing its dimension after the diameter of the expandable part 3 decreases due to spring back effects in the material of the expandable part. The spring elements 43 shown in FIG. 4*a* are in an unexpanded state. As shown in FIG. 4*b*, the annular sealing element 4 engages the inner surface 21 of the outer structure 2 towards the end of expansion, thereby creating a tight seal between the inner surface 21 and the annular sealing sleeve 41. When expansion is terminated, the expandable part 3 partially retracts due to the spring back effect, resulting in a complete or partial loss of the sealing effect, as shown in FIG. 4*c*. However, as shown in FIG. 4*c*, borehole fluid 20 is allowed to enter the annular sealing element cavity through an opening or perforation 45, thereby getting into contact with the expandable element 44, which may be made of a swellable material, causing it to start increasing its volume when getting into contact with the borehole fluid 20, as shown in FIG. 4*d*. When the expandable element 44 starts to expand as it is mixed with the borehole fluid, the seal between the inner surface 21 of the outer structure 2 and the annular sealing element 4 is restored, and the annular barrier is now more tight. The expandable element 44 may alternatively be pressure sensitive, electrically sensitive, magnetically sensitive or radiation sensitive chemical compositions, which may be initiated by applying a pressure, such as the expansion pressure, an electrical current, a magnetic field or radiation, respectively.

Figure 5:
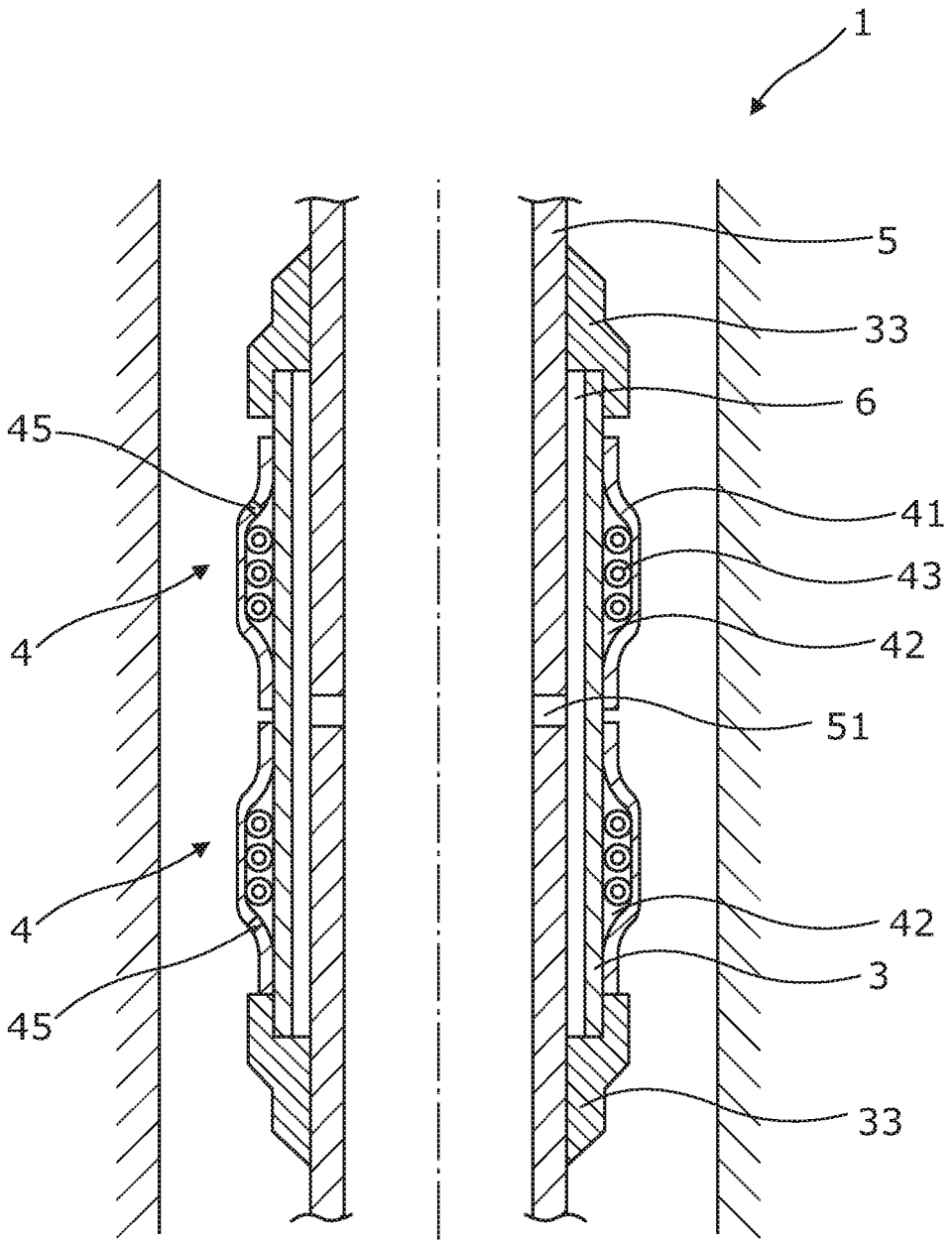
FIG. 5 shows a schematic view of another downhole annular barrier.
Figure 6:
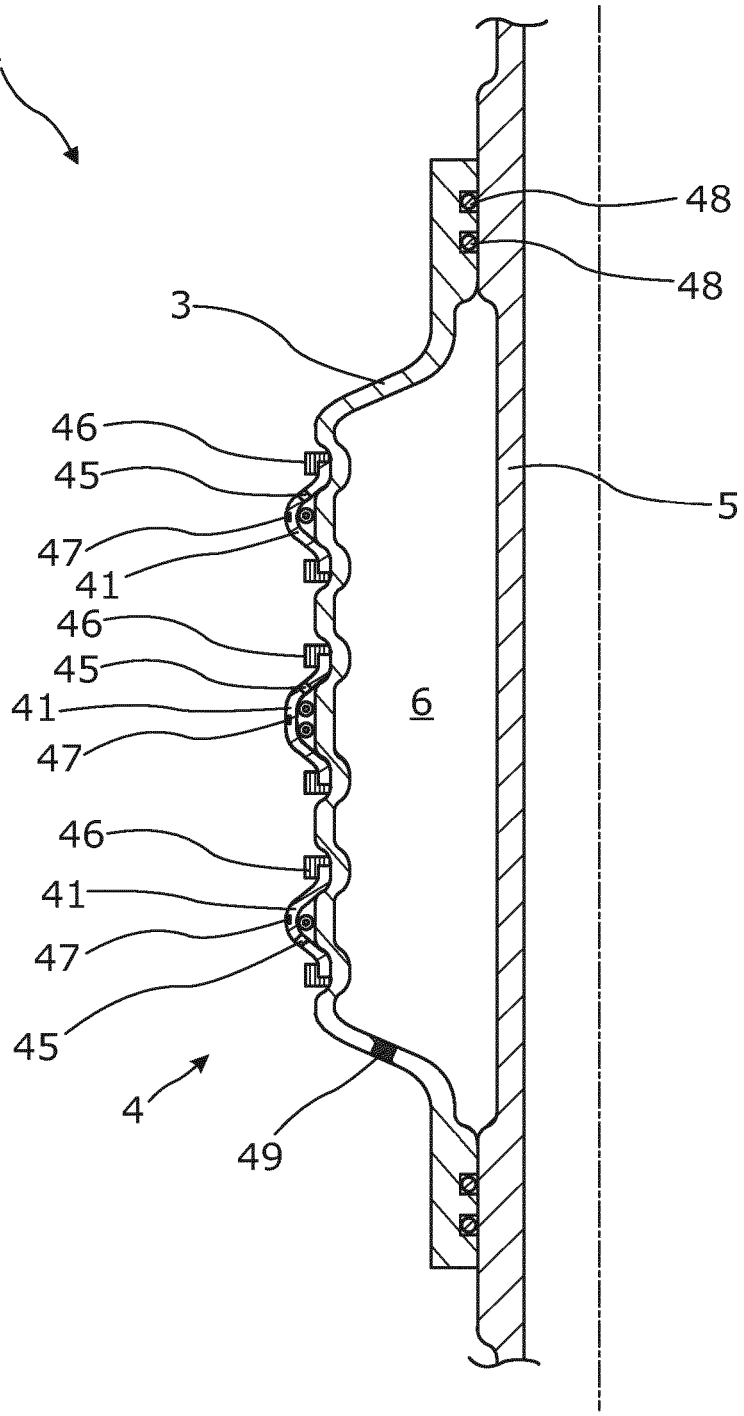
FIG. 6 shows a schematic view of another downhole annular barrier.

FIG. 5 shows another downhole annular barrier 1 comprising two separate annular sealing elements 4 each comprising three closed loop or helical spring elements 43 in the annular sealing element cavity 42. The expandable part 3 has been connected with the tubular part 5 by a first connection part 32 and a second connection part 33. One or more of the connection parts 32, 33 may be slidably connected with the tubular part 5 to decrease the pressure necessary to expand the expandable part 3. As seen in FIG. 6, the annular sealing sleeve 4 may be connected with the expandable part by connection parts 46 as well. The connection parts 46 may serve an additional purpose besides connecting the annular sealing sleeve 41 to the expandable part, namely to restrict expansion of the expandable part 3 in certain regions, resulting in a corrugated structure of the expanded expandable part 3, as shown in FIG. 6. This corrugated structure increases the strength of the downhole annular barrier 1, thereby increasing the collapse pressure, i.e. the pressure in the borehole, which may cause the downhole annular barrier 1 to collapse. In addition, the connection parts 46 protect the annular sealing sleeve 41 when the annular barrier is inserted in the well as part of the well tubular structure. Furthermore, the downhole annular barrier 1 may comprise a sensor 47 for determining the degree of expansion of the downhole annular barrier 1, e.g. by measuring pressure towards the inner surface of the outer structure or by measuring the diameter of the annular sealing sleeve 41 or the diameter of the expandable part 3. The annular barrier may also comprise a valve 49, such as a one-way valve, for allowing borehole fluid to enter the downhole annular barrier 1 if the pressure of the borehole fluid becomes higher than the pressure inside the annular barrier, thereby preventing a collapse of the downhole annular barrier 1.

Also, the annular sealing sleeve 41 may be perforated in the form of openings 45, and as shown in FIG. 6, the expandable part 3 may be slidably connected with the tubular part 5 and tightened by seals 48.

Figure 7:
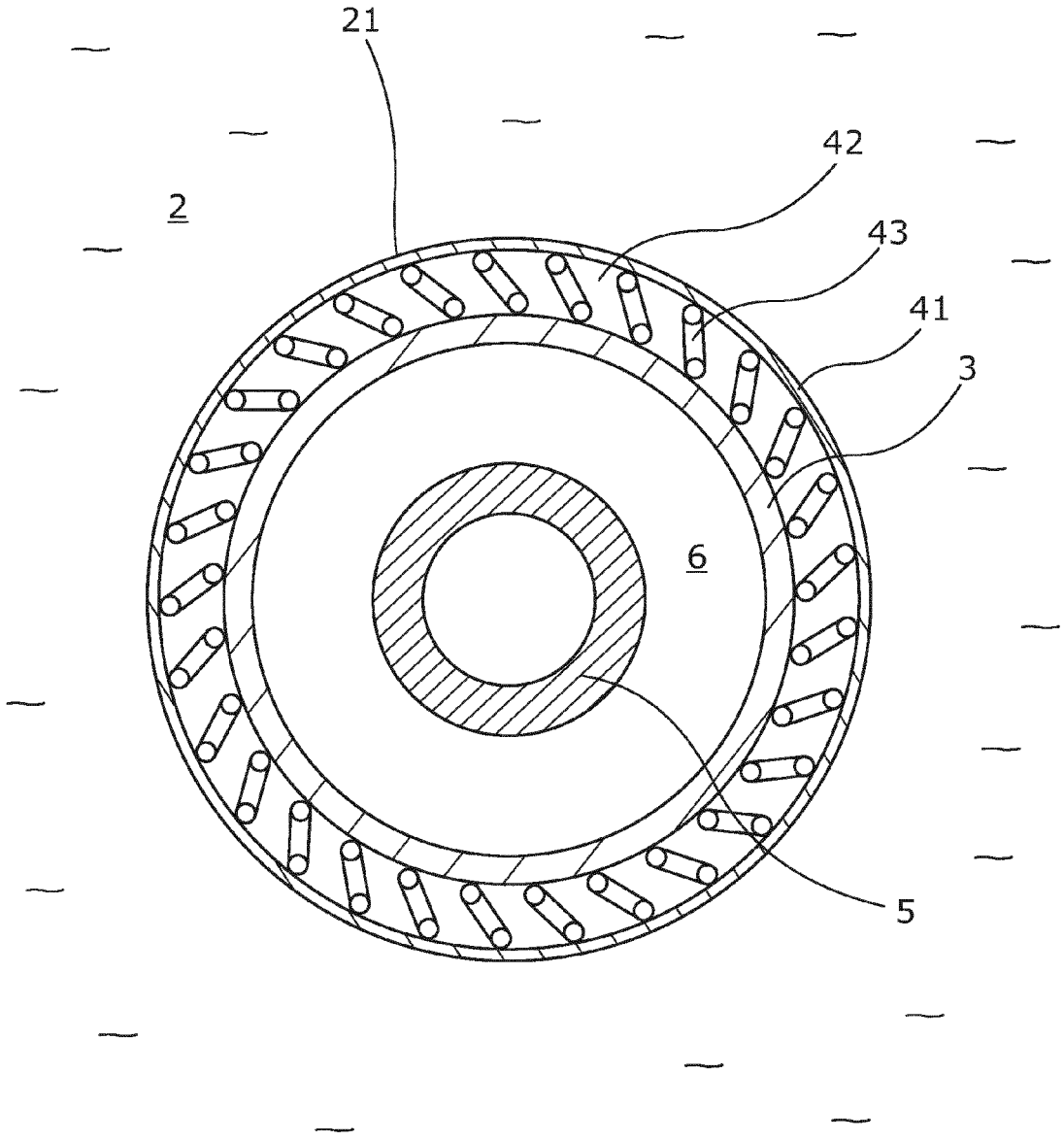
FIG. 7 shows a cross-sectional view of a downhole annular barrier.

FIG. 7 shows a cross-sectional view of the downhole annular barrier as shown in FIGS. 1, 2, 3, 5 and 6, comprising a spring element 43. As illustrated, the coiling of the spring element 43 is preferably transverse to the axial extension of the downhole annular barrier 1 so that the spring element 43 braces the annular sealing sleeve 41 all the way around the circumference of the annular sealing sleeve 41. In this way, it is able to create a tight seal towards the inner surface 21 of the outer structure 2 which is normally substantially circular in downhole environments. The spring elements 43 may be joined end to end, forming rings of coiled springs as shown in FIG. 7. The annular barrier of FIG. 7 is shown in its expanded position.

Figure 8:
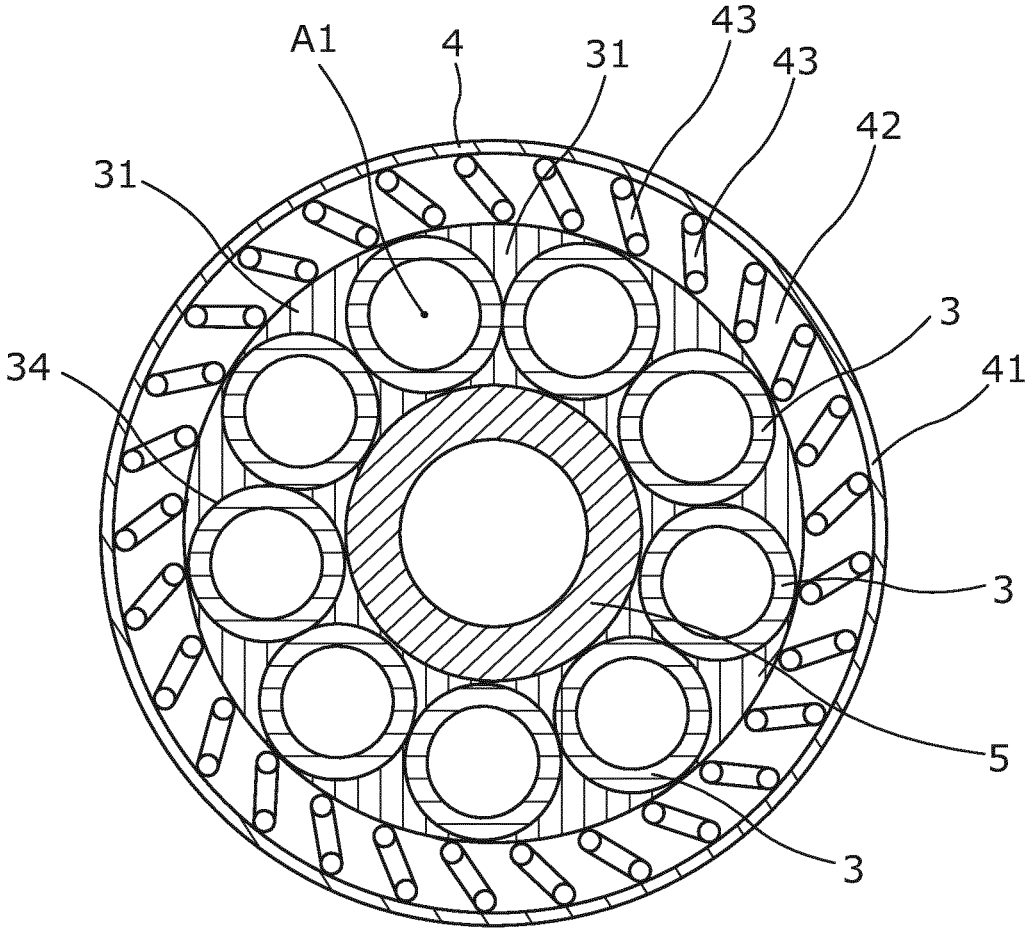
FIG. 8 shows a cross-sectional view of another downhole annular barrier.

As shown in FIG. 8, the annular barrier may comprise a plurality of expandable parts 3, in the form of elongated expandable tubes, extending outside the tubular part 5. The expandable parts 3 may be arranged around the periphery of the tubular part 5. A centre axis A1 of each of the expandable parts 3 thus extends outside the tubular part 5 in the longitudinal direction of the downhole annular barrier 1. This is in contrast to the design of prior art annular barriers, as described under background art, where the tubular part extending in a longitudinal direction, such as a casing, is surrounded by an expandable sleeve encircling the tubular part. The expandable tubes are attached to the tubular part 5. The downhole annular barrier 1 comprises an embedding element 31 provided on an outer surface 34 of the plurality of expandable parts 3. The embedding element 31 thus forms an expandable sleeve. Hereby, the embedding element 31 or expandable sleeve is adapted to provide a sealing barrier between the tubular part and annular sealing element 4. The embedding element and/or the expandable sleeve may be made of metal, polymer, elastomer, rubber, a swellable material, etc. A swellable material may further increase the sealing effect of the sealing element or the expandable sleeve as the material may be designed to swell when it comes into contact with specific types of fluid, such as water present in the borehole, an injected liquid or gas, etc.

The expandable part 3 and the annular sealing sleeve 41 are, in preferred embodiments, made of a metallic material to be able to withstand high temperatures. Also, the spring element 43 is preferably made of metallic materials in preferred embodiments where heat resistance is important. In this way, all parts and seals are made of metal capable of withstanding the harsh environment downhole with high temperature, high pressure and an acid containing well fluid.

If lower working temperatures are present in the well, the annular sealing sleeve may be made of an elastomeric material.

The annular sealing sleeve 4 may preferably be made of a material having a lower E-modulus than the expandable part to ease the expansion of the downhole annular barrier 1.

The spring element 43 is preferably a coil spring or helical spring 43, but is not restricted to be coil springs, and in case of several windings in one annular sealing element cavity 42, the windings may be parallel closed loop springs, or one long coil spring wound around the tubular part 5.

To increase the possible expansion ratio of the downhole annular barrier 1 between the unexpanded and expanded state, the expandable part 3 may have a centre axis A1 extending outside the tubular part 5 in the longitudinal direction, as shown in FIG. 8. The centre axis of the expandable part or tube may also in some embodiments coil around the tubular part in the longitudinal direction. These types of expandable parts 3 may be substantially oval-shaped in cross-section in a relaxed position and substantially circular when expanded. Furthermore, the downhole annular barrier 1 may comprise a plurality of such expandable parts 3 extending on the outside of the tubular part in the longitudinal direction.

Both expandable elements 44 and spring elements 43 may be arranged in the same annular sealing element cavity to improve the sealing effect of the downhole annular barrier 1, as shown in FIGS. 4*a-d*.

The invention also relates to a method of providing a seal comprising the steps of inserting an annular barrier in a borehole and expanding the expandable part by injecting pressurised fluid into an aperture. The spring element 43 is then compressed when the outer surface 11 of the annular barrier engages with the inner surface 21 of the outer structure 2 by further injecting pressurised fluid into the aperture 51. After ending the injection of pressurised fluid into the expandable part, the expandable part 3 is minimised due to spring back of the material of the expandable part. The minimisation of the expandable part results in a decompression of the spring member 43 so that pressure exerted by the annular sealing element 4 on the inner surface 21 of the outer structure 2 is maintained, and a sealing effect of the annular barrier is also maintained.

An additional sealing effect of the downhole annular barrier 1 is also obtained by allowing borehole fluid to enter the annular sealing element cavity 42 at the inlet hole 45. By allowing borehole fluid to enter the annular sealing sleeve cavity 42, a very high pressure in the borehole fluid is not destructive to the sealing effect, since the pressure inside the annular sealing sleeve 41 in the annular sealing sleeve cavity 42 is equalised with the borehole pressure. Therefore, the sealing effect is still safeguarded during high borehole pressures by the sealing effect of the spring element 43.

The invention also relates to another method of providing a seal comprising the steps of inserting an annular barrier in a borehole and expanding the expandable part by injecting pressurised fluid into an aperture. When the expandable part is fully expanded, the injection of pressurised fluid into the space 6 has ended and the expandable part 3 is minimised accordingly due to spring back of the material constituting the expandable part 3. Due to the spring back of the expandable part 3, the seal provided by the downhole annular barrier 1 may have become poorer. However, when the expandable part 3 has been expanded, the expandable element 44 arranged in the annular sealing element 4 is also expanded so that pressure exerted by the annular sealing element 4 on the inner surface 21 of the outer structure 2 is maintained. A sealing effect of the annular barrier is also obtained by allowing borehole fluid to enter the annular sealing element cavity 42 at the inlet hole 45 and to come into contact with the expandable element 44 arranged in the annular sealing element cavity 42. In this way, the annular sealing sleeve 41 is directionally energised from within, thus closing the gap between the borehole surface 21 and the outside of the sealing sleeve 41 and achieving a stronger sealing effect. Alternatively, a fluid may purposefully be injected into the expandable part to commence swelling.

Furthermore, the expandable part 3 preferably has a wall thickness which is thinner than a length of the expandable part, the thickness preferably being less than 25% of the length, more preferably less than 15% of the length, and even more preferably less than 10% of the length.

A downhole annular barrier 1 may also be called a packer or similar expandable means. The well tubular structure can be the production tubing or casing or a similar kind of tubing downhole in a well or a borehole. The downhole annular barrier 1 can be used both in between the inner production tubing and an outer tubing in the borehole or between a tubing and the inner wall of the borehole. A well may have several kinds of tubing, and the downhole annular barrier 1 of the present invention can be mounted for use in all of them.

The valve 49 may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve, or plug valve.

The expandable part 3 may be a tubular metal sleeve obtained from a cold-drawn or hot-drawn tubular structure.

The fluid used for expanding the expandable part may be any kind of borehole fluid or well fluid present in the borehole surrounding the tool and/or the well tubular structure. Also, the fluid may be cement, gas, water, polymers, or a two-component compound, such as powder or particles mixing or reacting with a binding or hardening agent or a thermo-hardening fluid, such as resin, commonly used within the art. Part of the fluid, such as the hardening agent, may be present in the cavity between the tubular part and the expandable sleeve before injecting a subsequent fluid into the cavity.

By fluid, borehole fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure 23 is meant a casing which is any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole annular barrier with an axial extension having an outer surface facing an inner surface of an outer structure, comprising:

a tubular part, an expandable part arranged around the tubular part, and at least one annular sealing element directly connected with the expandable part and having an axial length along the axial extension of the downhole annular barrier which is less than 50% of a length of the downhole annular barrier along the axial extension of the downhole annular barrier, wherein the annular sealing element comprises a spring element, and the annular sealing element further comprises an annular sealing sleeve connected with the expandable part and at least partly defining an annular sealing element cavity between the expandable part and the annular sealing sleeve, and wherein the spring element is arranged in the annular sealing element cavity, and wherein the spring element is configured so that when expanding the annular barrier the spring element is compressed providing an inherent spring force in the spring element, enabling the spring element to expand when the expanded expandable part settles after expansion, wherein at least a portion of the expandable part forms an outermost surface of the downhole annular barrier.

2. The downhole annular barrier according to claim 1, wherein the annular sealing sleeve is made of a metallic material.

3. The downhole annular barrier according to claim 1, wherein an expandable element is arranged in the annular sealing element cavity.

4. A seal providing method comprising:

inserting a downhole annular barrier according to claim 3 in a borehole, expanding the expandable part by injecting pressurised fluid into an aperture, minimising the expandable part by ending the injection of pressurised fluid due to spring back of the expandable part, and expanding the expandable element so that the pressure exerted by the annular sealing element on the inner surface of the outer structure is maintained, and a sealing effect of the downhole annular barrier is maintained.

5. The downhole annular barrier according to claim 1, wherein the expandable part is an expandable sleeve surrounding the tubular part.

6. The downhole annular barrier according to claim 5, wherein the expandable sleeve is a metal sleeve.

7. The downhole annular barrier according to claim 1, wherein the spring element is made of a metallic material.

8. The downhole annular barrier according to claim 1, wherein the annular sealing sleeve has at least one opening or is perforated.

9. The downhole annular barrier according to claim 1, further comprising connection parts for connecting the annular sealing sleeve with the expandable part.

10. The downhole annular barrier according to claim 1, further comprising a sensor for determining a pressure exerted by the annular sealing element on the inner surface of the outer structure.

11. The downhole annular barrier according to claim 1 further comprising:

a first connection part surrounding and connected with a first end of the tubular part, and a second connection part surrounding and connected with a second end of the tubular part, wherein the expandable part is connected with the first connection part and the second connection part, the expandable part, the first and second connection parts and the tubular part enclosing an inner space, and wherein the first connection part is slidably connected with the tubular part.

12. A downhole system comprising a well tubular structure and at least one downhole annular barrier according to claim 1, wherein the tubular part forms part of the well tubular structure.

13. The downhole system according to claim 12, wherein a plurality of downhole annular barriers is positioned at a distance from each other along the tubular part.

14. A seal providing method comprising:

inserting a downhole annular barrier according to claim 1 in a borehole, expanding the expandable part by injecting pressurised fluid into an aperture, compressing the spring element when the outer surface of the downhole annular barrier engages the inner surface of the outer structure by further injecting pressurised fluid into the aperture, minimising the expandable part when the injection of pressurised fluid has ended due to spring back of the expandable part, and decompressing the spring element so that the pressure exerted by the annular sealing element on the inner surface of the outer structure is maintained, and a sealing effect of the downhole annular barrier is also maintained.

15. The downhole annular barrier according to claim 1, wherein the spring element comprises a coiled or helical spring.

16. The downhole annular barrier according to claim 1, wherein the annular sealing sleeve is directly connected with the expandable part.

17. The downhole annular barrier according to claim 1, wherein the spring element extends continuously around the expandable part.

18. The downhole annular barrier according to claim 1, wherein a center portion of the annular sealing sleeve is spaced a greater distance away from the expandable part than are ends of the annular sealing sleeve.

* * * * *